US005181970A

United States Patent [19]

Ueda et al.

[11] Patent Number: 5,181,970

[45] Date of Patent: Jan. 26, 1993

[54] PROCESS FOR PRODUCTION OF STAINLESS STEEL THIN STRIP AND SHEET HAVING SUPERIOR SURFACE GLOSS AND HIGH RUSTING RESISTANCE

[75] Inventors: Masanori Ueda; Masamitsu Tsuchinaga, both of Kitakyushu; Teruo Iura, Hikari; Shigeru Fujiwara, Kitakyushu, all of Japan

[73] Assignee: Nippon Steel Corporation, Tokyo, Japan

[21] Appl. No.: 476,423

[22] PCT Filed: Sep. 8, 1989

[86] PCT No.: PCT/JP89/00927

§ 371 Date: Jun. 13, 1990

§ 102(e) Date: Jun. 13, 1990

[87] PCT Pub. No.: WO90/02615

PCT Pub. Date: Mar. 22, 1990

[30] Foreign Application Priority Data

Sep. 8, 1989 [JP] Japan ..... 63-225430

[51] Int. Cl.[5] ..... C21D 8/02

[52] U.S. Cl. ..... 148/610; 148/287; 72/366.2

[58] Field of Search ..... 148/12 E, 12 EA, 12.1; 420/62, 70, 71; 72/366.2

[56] References Cited

FOREIGN PATENT DOCUMENTS 59-173224 10/1984 Japan ..... 148/12.1
60-262922 12/1985 Japan ..... 148/12.1
61-12828 1/1986 Japan ..... 148/12 EA
61-49701 3/1986 Japan ..... 72/366.2
61-163216 7/1986 Japan ..... 148/12 E
62-224417 10/1987 Japan ..... 148/12.1

*Primary Examiner*—George Wyszomierski
*Attorney, Agent, or Firm*—Kenyon & Kenyon

[57] ABSTRACT

According to the present invention, a stainless steel thin strip and sheet having a superior surface gloss and high rusting resistance is produced by heating a continuous cast slab of ferritic or martensitic stainless steel containing 10 to 35% by weight of Cr at a temperature of 1100° to 1300° C. selected according to the Cr content in a combustion atmosphere having an oxygen concentration lower than 7% while adjusting the furnace staying time from preheating to extrusion to within 260 minutes, carrying out hot rolling while adjusting the rolling-finish temperature to a level higher than 900° C., carrying out mechanical descaling by adding a grinding and descaling agent, such as iron sand, having a maximum particle size smaller than 400 μm, to high-pressure water and spraying the mixture onto the steel strip, pickling the steel strip, cold-rolling the steel strip while maintaining the relationship between the roll diameter and the reduction ratio within the "overlap"-free region shown in FIG. 3, carrying out finish cold rolling by work rolls having a diameter smaller than 100 mm, if necessary, and subjecting the steel strip to final annealing. Optionally, a winding step may be performed after hot rolling, and/or a final pickling step may be performed after the final annealing.

8 Claims, 3 Drawing Sheets

PROCESS FOR PRODUCTION OF STAINLESS STEEL THIN STRIP AND SHEET HAVING SUPERIOR SURFACE GLOSS AND HIGH RUSTING RESISTANCE

TECHNICAL FIELD

The present invention relates to a process for the production of ferritic stainless steel or martensitic stainless steel thin strips and sheets. More particularly, the present invention relates to a process for producing stainless steel sheets having a good surface gloss and high rusting resistance or superior grindability by controlling rusting origins. Especially, the present invention relates to slab heating conditions and hot rolling conditions, and methods of mechanical descaling and cold rolling.

BACKGROUND ART

As the stainless steel thin sheet products, there can be mentioned the 2B product, BA product and polished product specified by JIS. The commercial values of these stainless steel sheet products are determined by surface characteristics such as the gloss, rusting resistance, presence or absence or degree of flaws called "gold dust", peculiar to BA products, and the grindability, and accordingly, there is a need to improve these characteristics.

To satisfy this demand, there have heretofore been adopted a process in which a hot-rolled strip before cold rolling is annealed and pickled and the surfaces then ground to remove flaws (called "coil grinding"), a double rolling/annealing method, and a method in which heat streaks are formed at the cold-rolling step, but satisfactory results cannot be always obtained according to these methods.

The inventors carried out research with a view to developing a production process for obtaining stainless steel thin sheets having superior surface characteristics and clarified the causes of the forming of concavities and convexities on the surface of the product under various conditions, including slab-heating conditions and hot-rolling conditions, while omitting the coil grinding step of removing surface flaws by grinding the surfaces of a strip and searched for a means of eliminating these causes.

The technical problem concerning the surface characteristics of a stainless steel product is how to produce a product having a good gloss, high rusting resistance and superior grindability, and free of flaw called "gold dust". Our research found that the main causes of the degrading of these characteristics are "overlap" defects present on the surface of a cold-rolled material.

These "overlap" defects are caused by the following surface unevennesses or pitting before cold-rolling.

i) A concavity formed by intergranular corrosion caused at the pickling of a hot-rolled strip.

ii) An undulation present on the surface of a pickled material, which is generally called "surface roughness".

iii) A grind grain left at the grinding of the surfaces of a pickled material.

Of these surface unevennesses or pitting, the concavity i) by intergranular corrosion can be prevented by the method of preventing the sensitization of the material or by the selection of appropriate composition for the pickling solution. In connection with the grind grain iii) left after the grinding, desirably the grind grain is made finer, but to prevent a formation of this unevenness, the coil grinding step should be omitted so that no grind grain is present.

The surface unevenness ii) called "surface roughness" has a large influence, because a large surface roughness results in a degradation of the surface properties of the product. As the means for reducing the surface roughness of the pickled material, there have been known a method in which the hardness of the material is increased at the mechanical descaling of the material (Japanese Examined Patent Publication No. 60-56768) and a method in which the surface roughness is reduced at the pickling step, as disclosed in Japanese Examined Patent Publication No. 61-38270 and Japanese Examined Patent Publication No. 49-16698.

DISCLOSURE OF THE INVENTION

An object of the present invention is to provide a production process in which stainless steel sheet products having surface characteristics can be obtained even if the coil grinding step is omitted, and another object of the present invention is to provide a process in which a stainless steel strip can be manufactured at a greatly increased productivity.

According to the present invention, the foregoing objects can be attained by providing a process for the production of stainless steel strips, which comprises heating a continuously cast slab or partially processed slab of ferritic or martensitic stainless steel containing 10 to 35% by weight of Cr at a temperature of 1100° to 1300° C. selected according to the Cr content in combustion atmosphere having an oxygen concentration lower than 7% while adjusting the furnace staying time from preheating to extraction to within 260 minutes, carrying out hot rolling while adjusting the rolling-finish finish temperature to a level higher than 900° C., carrying out mechanical descaling by adding a grinding and descaling agent, such as an iron sand having a maximum particle size smaller than 400 μm, to high-pressure water and spraying the mixture onto the steel strip, pickling the steel strip, without grinding (coil grinding) the surface of the strip, cold-rolling the steel strip while maintaining the relationship between the roll diameter and the reduction ratio within the "overlap"-free region shown in FIG. 3, and subjecting the steel strip to final annealing.

BEST MODE OF CARRYING OUT THE INVENTION

The history of the development of the present invention will now be described.

To clarify the cause of the formation of unevennesses on the surface of a stainless steel strip, we investigated various conditions, beginning with a continuously cast slab. More specifically, the slab was heated in a heating furnace under various heating time and temperature conditions. Heated slabs differing in the thickness of the surface scale (oxide film) were hot-rolled. With respect to the hot-rolled materials, the relationship between the surface properties and the scale and the degree of surface unevenness were examined and analyzed, and as a result, it was found that the fundamental cause of a formation of unevenness on the surface of the hot-rolled strip, that is, the surface roughness, is a stuffing of scale, which is formed on the slab surface during the heating of the slab, into the material during the hot rolling. It also was found that, especially if the furnace staying time is long, an interior oxide layer extending concavely from the scale-base material interface toward the base material is formed, and this concave scale is easily stuffed into the material.

Figure 1:
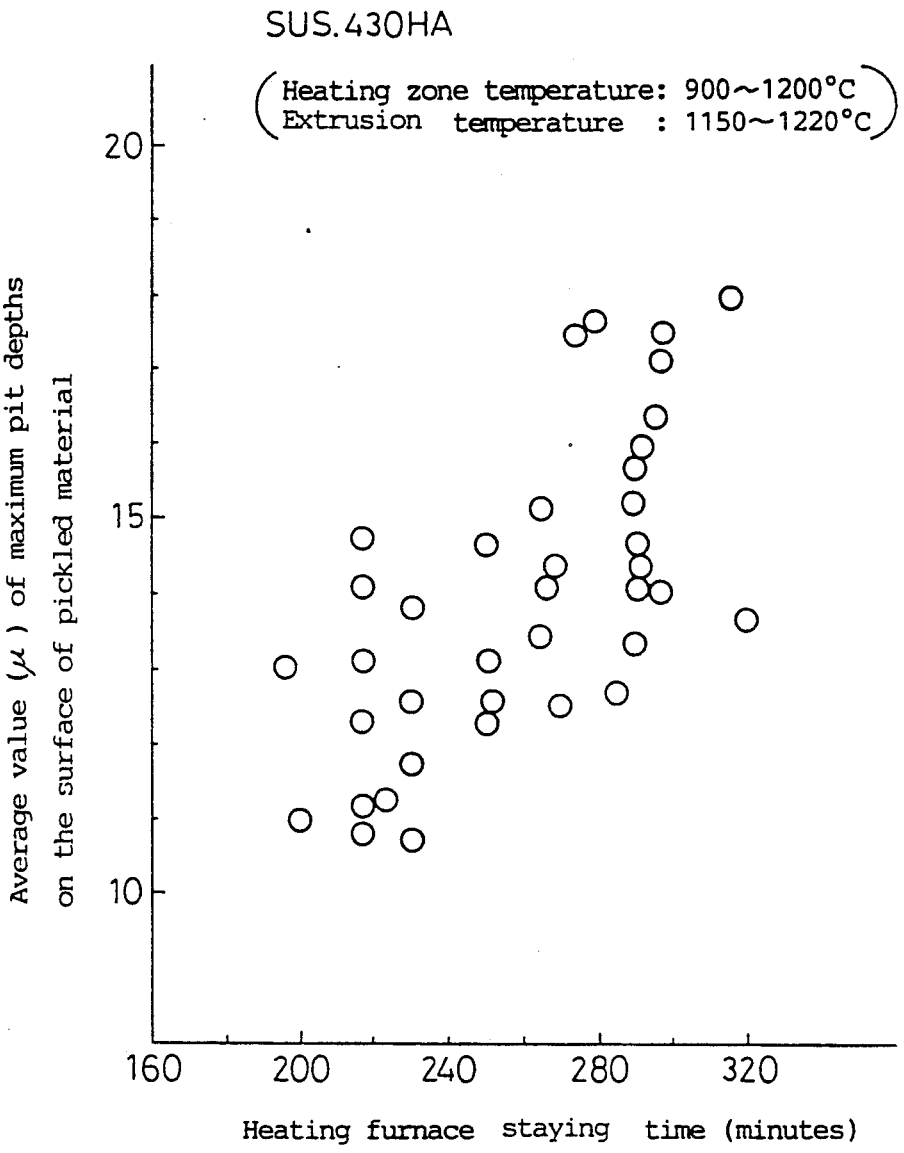
FIG. 1 illustrates the relationship between the furnace staying time at the step of heating a stainless steel slab and the concavity depth of the surface of the pickled material.

Thus, the properties of the scale and the hot rolling conditions have a close relationship to the formation of unevennesses on the surface of the material. We analyzed heating conditions and hot rolling conditions in practical lines and the depths of unevennesses on the surface of the pickled material, and as a result, found that a relationship shown in FIG. 1 is established between the slab-heating time and the depths of unevennesses of the pickled material. As apparent from FIG. 1, the furnace staying time at the slab-heating step has great influence on the depths of unevennesses of the pickled material.

The unevennesses on the surface of the material in FIG. 1 were evaluated by observing twenty optional visual fields on the surface of the pickled material by an optical microscope and calculating an average value of the depth of four of the deepest concavities in these twenty visual fields.

Among the hot rolling conditions, the rolling temperature has the closest relationship to the unevennesses on the surface of the pickled material.

The lower the hot rolling finish temperature, the larger the unevenness on the surface of the pickled material. If the material is subjected to descaling using high-pressure water during the hot rolling, the unevenness is reduced.

Figure 2:
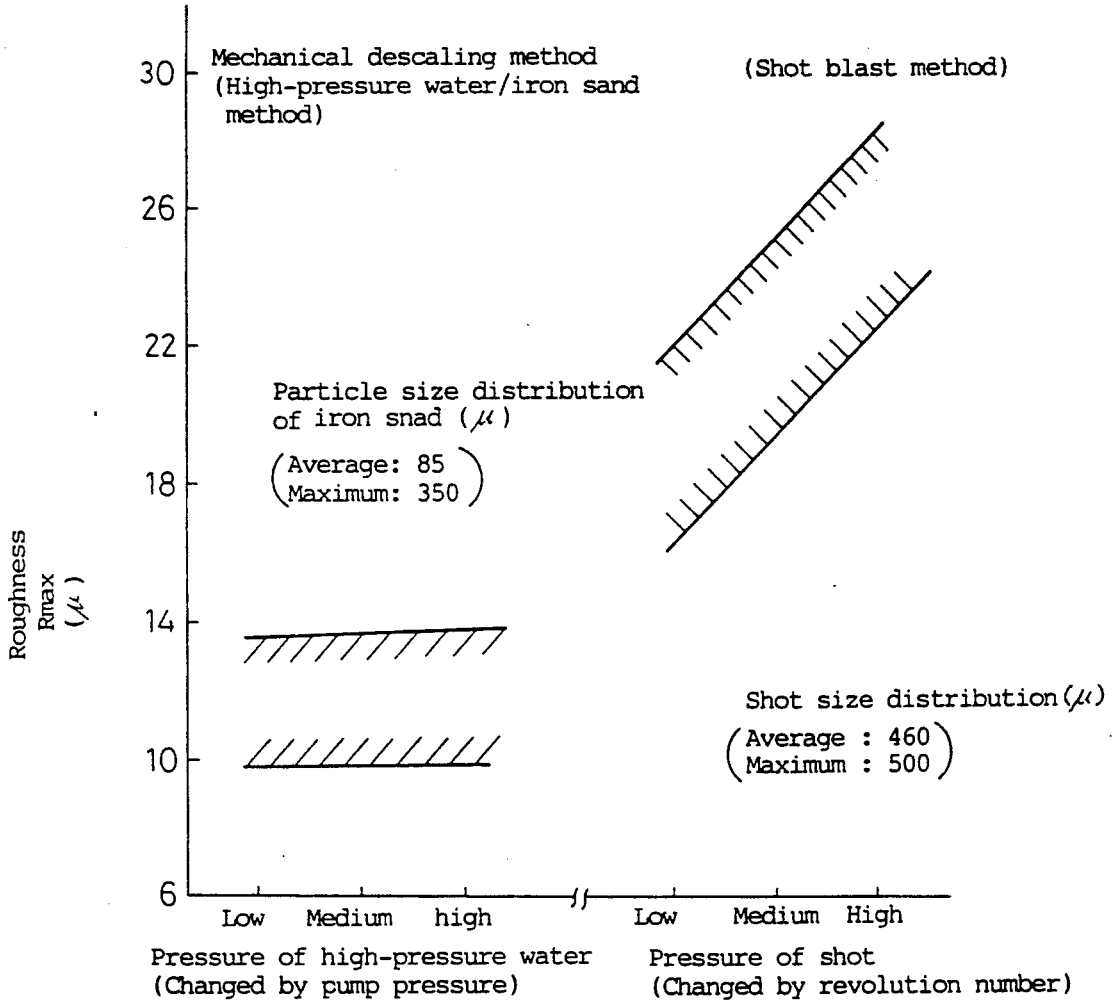
FIG. 2 illustrates the relationship between the kind of descaling method and the surface roughness of the pickled material.

Also the mechanical descaling method at the descaling step is a major cause of an increase of the unevennesses on the surface of the pickled material. According to the known shot blast method, as shown in FIG. 2 if the spraying force is increased, because of increased but the surface conditions of the pickled material are apparently degraded. According to the method of spraying high-pressure water in which grinding and descaling agents, such as iron sand, is incorporated, even if the pressure of the high-pressure water is increased to 100 to 300 kg/cm$^2$, the surface conditions of the pickled material are not degraded when the particle size of the grinding and descaling agent such as iron sand is appropriately selected. Namely, if the particle size of the grinding and descaling agent such as iron sand is selected so that the maximum particle size is smaller than 400 $\mu$m, the scale can be removed without degradation of the surface conditions of the material.

As pointed out hereinbefore, the causes of the formation of unevennesses on the surface of the material reside in a formation of scales at the slab-heating step, a stuffing of scales into the base material at the hot-rolling step, and the mechanical descaling method. Of course, to obtain a final product having superior surface properties, it is necessary to eliminate these causes. We further made investigations with a view to developing a method adopted at the cold-rolling step for improving the surface properties by repairing unevennesses on the surface of the material.

Figure 3:
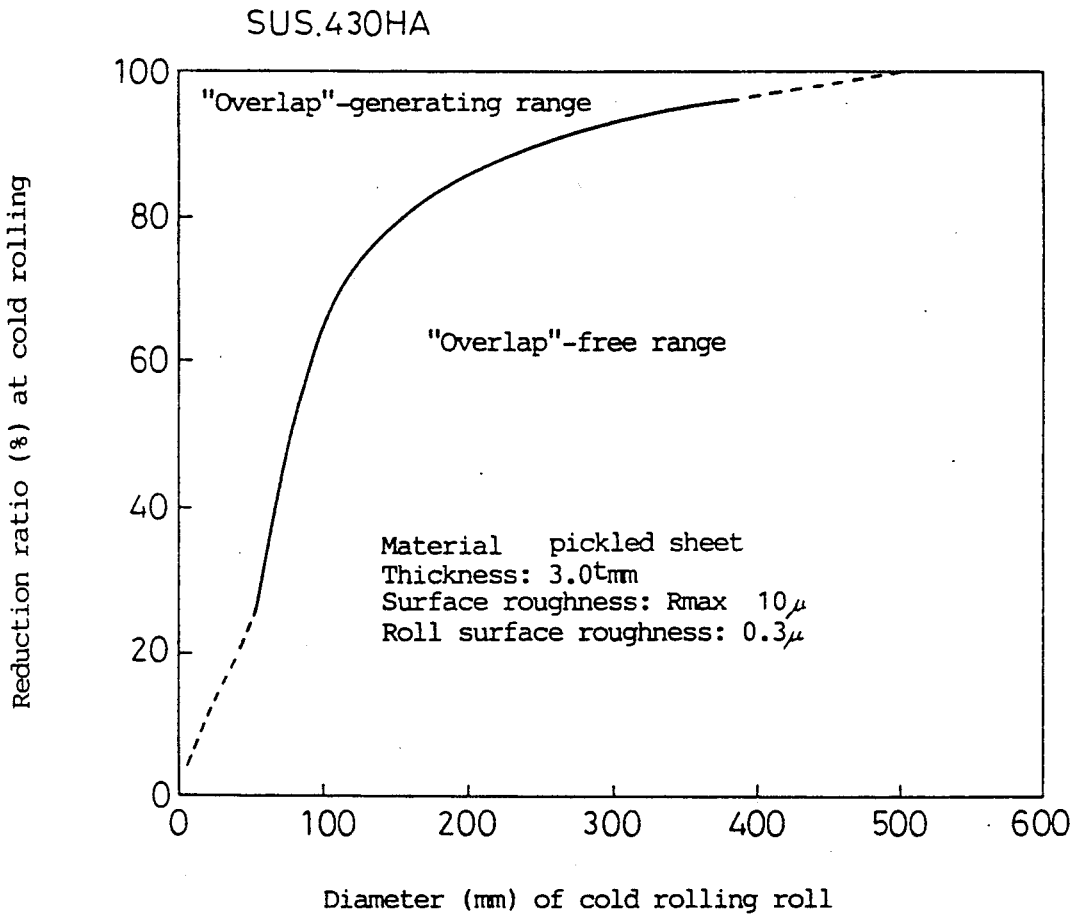
FIG. 3 shows the "overlap"-generating range relative to the combination of the work roll diameter and the reduction ratio at the cold-rolling step.

We noted the effect of the diameter of the work roll adopted at the cold-rolling step. When work rolls having large diameter are used at the cold-rolling step, a compressive stress acts on the surface of the material, and if rolls having a small diameter are used, shearing stress acts on the surface of the material. Accordingly, at the cold rolling using work rolls having a large diameter, the depth of the unevennesses on the surface of the material is gradually decreased by the compressive stress, and little "overlap" occurs. On the small diameter, the unevennesses on the surface of the material are stuffed under the shearing stress, to cause "overlap", while the surface gloss is increased. We examined the influences of the diameter of the work rolls at the cold-rolling step and the reduction ratio on "overlap" in the rolled material by using a material which was improved so as to reduce unevennesses on the surface of the material after pickling. The results are shown in FIG. 3.

If the cold rolling is carried out by using work rolls having a large diameter of 400 mm, even when the reduction ratio is as high as at least 95%, "overlap" does not occur. On the other hand, where the cold rolling is carried out by using work rolls having a small diameter of 70 mm, "overlap" occurs at a 40% reduction ratio, and where the cold rolling is carried out by using mark rolls having a medium diameter of 150 mm, a small "overlap" appears if the reduction ratio is 80%.

Use of work rolls having a large diameter of, for example, 400 mm, is effective for preventing an occurrence of "overlap", but the cold rolling using work rolls having a small diameter is effective for improving the surface gloss. Accordingly, to obtain a final product having a good surface gloss without "overlap", there is preferably adopted a method in which, at the former stage, the cold rolling is carried out by using work rolls having a large or medium diameter in the "overlap"-free range of the combination of the work roll diameter and the reduction ratio, to reduce the depth of unevennesses on the surface of the material, and at the final stage, the rolling is carried out by using small-diameter work rolls to improve the gloss. Accordingly, it is important that, in the "overlap"-free range of the combination of the work roll diameter and the reduction ratio shown in FIG. 3, the cold rolling should be first carried out by using work rolls having a large diameter at the cold rolling of a pickled material. After the depth of unevennesses on the surface of the material is reduced at the former stage of the cold rolling by using work rolls having a large diameter, if the cold rolling is carried out at the final stage even by using work rolls having a small diameter such as 70 mm, since the unevennesses on the surface of the material have been repaired, "overlap" does not occur and the gloss is improved.

The best mode of carrying out the present invention will now be described.

As the steel used in the present invention, there can be mentioned martensitic steels such as 13Cr steel of the AISI 410 series and ferritic steels such as 17Cr steel of the AISI 430 series, and 19Cr steel having an increased Cr content.

From the viewpoint of the scale resistance of the steel at a Cr content of 10 to 35% in the slab, the slab-heating temperature is selected from the range of 1100° to 1300° C. In the case of a steel having a low Cr content of about 10%, a lower temperature of about 1100° to about 1200° C. is selected, and in the case of a steel having a Cr content of 20 to 35%, a higher temperature of 1150 to 1300° C. is selected. If the slab-heating temperature is lower than 1100° C., the heating is insufficient. If the slab-heating temperature is higher than 1300° C., oxidation of the slab is conspicuously advanced and the grain size becomes coarse.

The oxygen concentration in the combustion atmosphere in the heating furnace should be about 5% when heating a stainless steel. If the oxygen concenreduced.

The furnace staying time of the slab increases the unevennesses on the surface of the hot-rolled material through the increased thickness of the interior scale of the slab. As pointed out hereinbefore, if the furnace staying time is longer than 260 minutes, the degree of the unevennesses on the surface of the material is conspicuously increased. The higher the reduction ratio and the lower the material temperature at the hot rolling, the higher the degree of the unevennesses on the surface of the material. If the rolling-finish temperature is lower than 900° C., the degree of the unevennesses is especially increased. The higher rolling-finish temperature is preferable, but the upper limit is determined by the capacity of the rolling mill and is about 1050° C.

At the step of descaling the hot-rolled steel strip to reduce the unevennesses on the surface of the material, it is necessary to adopt a mechanical descaling method in which a grinding and descaling agent such as iron sand is added to high-pressure water and the mixture is jetted onto the surface of the strip. If the maximum particle size of the grinding and descaling agent such as iron sand is adjusted to less than 400 μm, the surface conditions of the material are especially improved. After the pickling, the cold rolling is subsequently carried out without performing the coil grinding of the surface of the strip.

At the cold-rolling step, the "overlap"-free range of the combination of the diameter of the work rolls and the reduction ratio is selected as described hereinbefore, and at the former stage, the depth of the unevennesses on the surface of the material is reduced by carrying out the rolling by using work rolls having a large diameter and at the latter stage, the rolling is carried out by using work rolls having a small diameter, to improve the surface gloss. At this step, the diameter of the work roll is important.

When the rolling is carried out by using work rolls having a small diameter, the unevennesses on the surface of the material can be promptly repaired, but the unevennesses are drawn and yielded to cause "overlap", resulting in a degradation of the surface characteristics.

On the other hand, if the rolling is carried out by using work rolls having a large diameter, "overlap" does not occur but the repair of the unevennesses on the surface of the material is not promptly accomplished. Accordingly, to prevent the occurrence of "overlap", the "overlap"-free range of the combination of the diameter of the work roll and the reduction ratio, shown in FIG. 3, should be selected. To obtain a product having an excellent surface gloss without "overlap", there is preferably adopted a method in which unevennesses on the surface of the material are repaired by carrying out the rolling within the "overlap"-free range of the reduction ratio shown in FIG. 3, by using work rolls having a diameter of 150 to 600 mm, preferably about 400 mm, and the rolling then carried out by using work rolls having a small diameter of up to 100 mm, to improve the surface gloss.

In addition, the unevennesses on the surface of the material can be especially effectively reduced by carrying out the descaling by high-pressure water on the inlet side of a line of finish rolling mills at the hot-rolling step.

Furthermore, if the strip is wound at a temperature higher than 600° C. after the hot rolling, to effect self-annealing, the step of annealing the hot-rolled sheet can be omitted.

We omitted the step of annealing the hot-rolled strip in the case of steels having a Cr content of 10 to 18%, but the continuous annealing was conducted in the case of the 19%Cr steel.

The surface properties of the product are not substantially influenced by the presence or absence of the step of annealing the hot-rolled sheet.

A predetermined final annealing is carried out after the cold rolling, and then pickling or bright annealing is carried out, and thereafter, temper rolling is carried out according to customary procedures.

EXAMPLE

As shown in Table 1 and 2, 13%Cr steel (SUS 410 steel), 17%Cr steel (SUS 430 steel) and 19%Cr high-grade stainless steel melted and refined according to customary procedures were continuously cast, and surfaces of the obtained slabs were partially processed. The SUS 410 and SUS 430 steels were heated at 1180° C. in a combustion atmosphere. At this step, the slabs were heated while changing the furnace staying time corresponding to the sum of the preheating time, heating time, and soaking time within and outside the range of the present invention. In the case of the 19%Cr steel, the heating temperature was set at 1240° C.

After heating, each slab was hot-rolled to a thickness of 3 or 4 mm by a hot strip mill, and the hot strip was cooled and wound at a temperature of 600° to 900° C.

In most runs, the hot rolling-finish temperature was adjusted to a level higher than 900° C., but in some runs this temperature was adjusted to a level lower than 900° C. Moreover, in some runs, descaling by high-pressure water was carried out between the rough hot rolling step and the finish hot rolling step.

Then, in the case of the 13%Cr and 17%Cr materials, the annealing of the hot-rolled sheet was omitted, but the 19%Cr material was subjected to a continuous annealing. Then, mechanical descaling was carried out by applying high-pressure water maintained under a pressure of 100 to 150 kg/cm$^2$, in which iron sand having a maximum particle size smaller than 400 μm was incorporated as the grinding and descaling agent, to the surface of the strip. The particle size distribution of the iron sand was controlled so that the maximum particle size was smaller than 400 μm, but in some runs, iron sand having a maximum particle size larger than 400 mm was used. Moreover, the shot blast mechanical descaling was carried out in some runs.

Then, pickling with sulfuric acid as the pickling solution was carried out to complete the descaling.

The surface of the obtained pickled material was examined by an optical microscope, and the depth of unevennesses or pitting was measured according to the method in which twenty optional visual fields were examined by the optical microscope, the depths of the deepest unevennesses or pitting in each visual field were measured, and the average value of four largest values among the collected data was calculated.

From the results, it was found that the influences of the furnace staying time at the slab-heating step are prominent, and if the furnace staying time exceeds 260 minutes, the depth of unevennesses on the surface of the material is dramatically increased. In the material subjected to the shot blast descaling, the unevennesses on the surface of the material were deep.

Then, each material was cold-rolled. At the cold-rolling step, the rolling of the former stage was carried out by a tandem mill using work rolls having a diameter of 400 mm or a reverse mill using work rolls having a diameter of 150 mm, and the finish rolling was carried out by a reverse mill using work rolls having a diameter of 70 mm. In most runs, the material having a thickness of 3 or 4 mm was reduced to 1 mm at a high speed at the former stage by the tandem mill using work rolls having a diameter of 400 mm. Then, the finish rolling was carried out to a thickness of 0.4 mm by a Senzimer mill having work rolls with a diameter of 70 mm.

In the case of the run of the conventional method (the steel composition was the same as that of SUS 430 used in the present invention), the material having a thickness of 3 mm was rolled to 0.4 mm by using a 70 mm.

In the CG-effected run, a steel having the same composition as that of the 19%Cr steel used in the present invention was pickled and then subjected to coil grinding, and the rolling was carried out in the same manner as in the conventional method.

As a result, it was found that, in comparative runs 6, 8 and 12 and the conventional method, "overlap" was conspicuous and many defects called "gold dust" appeared, and the gloss or rusting resistance was poor.

In contrast, if the cold rolling of the former stage was carried out by using work rolls having a large diameter (400 mm) or a medium diameter (150 mm), most of the obtained products were satisfactory. Namely, even if unevennesses were formed on the surface of the material, the repairing action was exerted, but if the depths of the unevennesses on the surface of the material was too large, the products were not satisfactory.

Accordingly, it was confirmed that, by adopting process in which unevennesses on the surface of the material are already reduced at the slab-heating step and at the former stage of the cold rolling, the rolling is carried out by using work rolls having a large or medium diameter, a product having superior surface properties can be obtained.

TABLE 1

| | Composition (% by weight) | | | | | | | | | |
|---|---|---|---|---|---|---|---|---|---|---|
| Kind of Steel | C | Si | Mn | P | S | Cr | Al | Nb | Ti | N |
| 410 | 0.05 | 0.52 | 0.45 | 0.020 | 0.003 | 13.2 | 0.01 | — | — | 0.012 |
| 430 | 0.04 | 0.44 | 0.35 | 0.024 | 0.004 | 16.4 | 0.12 | — | — | 0.011 |
| 19Cr | 0.01 | 0.33 | 0.36 | 0.020 | 0.003 | 19.3 | 0.04 | 0.20 | 0.15 | 0.010 |

TABLE 2

| Run No. | Kind of Steel | Heating Furnace Conditions: heating temperature (°C.) | Heating Furnace Conditions: furnace staying time (minutes) | Hot Rolling Conditions: hot rolling-final temperature (°C.) | Hot Rolling Conditions: high-pressure descaling during hot rolling | Mechanical Descaling Method | Average Depth* (μm) of Unevennesses on Pickled Sheet | Combination** of Cold Rolling Conditions: large-diameter roll (400ϕ) | Combination** of Cold Rolling Conditions: medium-diameter roll (150ϕ) | Combination** of Cold Rolling Conditions: small-diameter roll (70ϕ) | Evaluation of Surface of BA Product: gold dust | Evaluation of Surface of BA Product: gloss | Evaluation of Surface of BA Product: rusting resistance*** |
|---|---|---|---|---|---|---|---|---|---|---|---|---|---|
| (1) | SUS410 | 1180 | 190 | 930 | not effected | high-pressure water + iron sand | 10.5 | 75% | → | 60% | ○ | ○ | ○ |
| (2) | SUS430 | 1180 | 200 | 930 | " | high-pressure water + iron sand | 11.0 | 67 | | 60% | ○ | ○ | ○ |
| (3) | SUS430 | 1180 | 200 | 930 | effected | high-pressure water + iron sand | 9.3 | 67 | | 60% | ○ | ○ | ○ |
| 4 | SUS430 | 1180 | 200 | 880* | not effected | high-pressure water + iron sand | 15.9 | 67 | | 60% | Δ | ○ | ○ |
| (5) | SUS430 | 1180 | 240 | 930 | " | high-pressure water + iron sand | 13.6 | | 75% | 60% | ○ | ○ | ○ |
| 6 | SUS430 | 1180 | 280* | 930 | " | high-pressure water + iron sand | 18.4 | | 75 | 60% | x | x | x |
| 7 | SUS430 | 1180 | 230 | 930 | " | iron sand* (maximum particle size larger than 400 μm) | 15.6 | 75 | | " | Δ | Δ | Δ |
| 8 | SUS430 | 1180 | 230 | 930 | " | shot blast* | 19.4 | 75 | | 60% | x | x | x |

| Run No. | Kind of Steel | Heating Furnace Conditions: heating temperature (°C.) | Heating Furnace Conditions: furnace staying time (minutes) | Hot Rolling Conditions: hot rolling-finish temperature (°C.) | Hot Rolling Conditions: high-pressure descaling during hot rolling | Mechanical Descaling Method | Average Depth* (μm) of Unevennesses on Pickled Sheet | Combination** of Cold Rolling Conditions: large-diameter roll (400ϕ) | Combination** of Cold Rolling Conditions: medium-diameter roll (150ϕ) | Combination** of Cold Rolling Conditions: small-diameter roll (70ϕ) | Evaluation of Surface of BA Product: gold dust | Evaluation of Surface of BA Product: gloss | Evaluation of Surface of BA Product: rusting resistance*** |
|---|---|---|---|---|---|---|---|---|---|---|---|---|---|
| (9) | 19Cr steel | 1240 | 180 | 950 | not effected | high-pressure water + iron sand | 6.0 | 67 | | 60% | ○ | ○ | ○ |
| (10) | 19Cr steel | 1240 | 230 | 950 | effected | high-pressure water + iron sand | 9.3 | 67 | | 60% | ○ | ○ | ○ |
| (11) | 19Cr steel | 1240 | 240 | 950 | not effected | high-pressure water + iron sand | 15.0 | 67 | | 60% | ○ | ○ | ○ |
| 12 | 19Cr steel | 1240 | 230 | 950 | " | shot blast* | 16.3 | 67 | | 60% | x | Δ | Δ |
| conventional method | SUS430 | 1180 | 270 | 910 | not effected | high-pressure water + iron sand | 11.8 | | | 70 | x | x | x |
| CG effected | 19Cr | 1240 | 240 | 920 | " | high-pressure water + iron | 10.0 | | | 70 | Δ | Δ | Δ |

TABLE 2-continued

| sand |
|---|

Note
Runs (1) through (3), (5), (9) through (11) are runs of present invention.
Runs 4, 6 through 8 and 12 are comparative runs
CG: coil grinding
* values outside scope of present invention.
*average value of 4 maximum depths among maximum depths of 20 examined visual fields of surfaces of pickled sheet.
**large-diameter roll → 4-stand tandem mill, medium-diameter and small-diameter rolls reverse mill.
***6 months' exposure test to factory atmosphere.
o: good
Δ: poor
x: bad Industrial Applicability According to the present invention, stainless steel strip and sheets having superior surface properties can be provided by a process in which the coil grinding step, which is indispensable for obtaining stainless steel sheets, especially a product having a superior surface gloss, in the conventional technique, is omitted, and a tandem mill having large-diameter work rolls, which has a high productivity, is effectively utilized instead of a Senzimer mill having small-diameter work rolls.

The present invention provides excellent effects of reducing the manufacturing cost, increasing the productivity, and shortening the production time in the production of stainless steel sheets.

What is claimed is:

1. A process for production of stainless steel thin strip and sheets having a superior surface gloss and high rusting resistance, which comprises heating a continuously cast slab or partially processed slab of ferritic or martensitic stainless steel containing 10 to 35% by weight of Cr at a temperature of 1100° to 1300° C. in a combustion atmosphere having an oxygen concentration lower than 7% while adjusting the staying time of from preheating to extraction to from said atmosphere to less than about 260 minutes, carrying out hot rolling while maintaining the rolling-finish temperature at a level higher than 900° C., winding the hot rolled strip at a temperature higher than 600° C., carrying out mechanical descaling by adding a grinding and descaling agent having a maximum particle size smaller than 400 μm to high-pressure water and spraying the mixture onto the steel strip, pickling the steel strip, cold-rolling the steel strip while maintaining the relationship between the roll diameter and the reduction ratio within the "overlap"-free region shown in FIG. 3, and subjecting the steel strip to final annealing.

2. A process for the production of stainless steel thin strip and sheets having a superior surface gloss and high resulting resistance, which comprises heating a continuously cast slab or partially processed slab of frerritic or martensitic stainless steel containing 10 to 35% by weight of Cr at a temperature 1100° to 1300° C. in a combustion atmosphere having an oxygen concentration lower than 7% while adjusting the staying time of from preheating to extraction to from said atmosphere to less than about 260 minutes, carrying out hot rolling while maintaining the rolling-finish temperature at a level higher than 900° C., carrying out mechanical descaling by adding a grinding and descaling agent having a maximum particle size smaller than 400 μm to high-pressure water and spraying the mixture onto the steel strip, prickling the steel strip, cold-rolling the steel strip while maintaining the relationship between the roll diameter and the reduction ratio within the "overlap"-free region shown in FIG. 3, and subjecting the steel strip to final annealing by carrying out final annealing in a combustion gas atmosphere, and then pickling he final annealed strip.

3. A process according to claim 1 or 2, wherein the steel strip is subjected to descaling using high-pressure water at an intermediate stage of the hot rolling step.

4. A process according to claim 1 or 2, wherein while maintaining the relationship between the roll diameter and the reduction ratio within the "overlap"-free range shown in FIG. 3, cold rolling is first carried out by using work rolls having a diameter of at least 150 mm and then finish cold rolling is carried out by using work rolls having a diameter smaller tan 100 mm.

5. A process according o claim 2, wherein the final annealing is a bright annealing.

6. A process according to claim 1 or 2, wherein the grinding and descaling agent is iron sand.

7. A process according to claim 2 wherein after the hot rolling, aid process further comprises the step of winding the hot-rolled steel strip at a temperature higher than 600° C.

8. A process according to claim 1 comprising carrying out said final annealing in a combustion gas atmosphere, and further comprising pickling he final annealed strip.

* * * * *

UNITED STATES PATENT AND TRADEMARK OFFICE
CERTIFICATE OF CORRECTION

PATENT NO. : 5,181,970

DATED : January 26, 1993

INVENTOR(S) : UEDA et al.

It is certified that error appears in the above-identified patent and that said Letters Patent is hereby corrected as shown below:

In Col. 3, line 46, prior to "increased" insert --the characteristics of the shot, the descaling force is--.

In Col. 4, line 12, prior to "small" insert --other hand, at the cold rolling using work rolls having a--.

In Col. 5, line 9, delete "concenreduced" and insert --concentration is higher than 7%, the combustion efficiency is reduced--.

In Col. 7, line 21, prior to "70mm" insert --a Senzimir mill using work mill rolls having a diameter of--.

Col. 13, line 1, after "for" insert --the--.

Col. 13, line 25, after "extraction" delete "to".

Col. 13, line 4, delete "frerritic" and insert --ferritic--.

Col. 14, line 5, after "extraction" delete "to".

Col. 14, line 17, delete "he" and insert --the--.

Col. 14, line 28, delete "tan" and insert --than--.

Col. 14, line 29, delete "o" and insert --to--.

UNITED STATES PATENT AND TRADEMARK OFFICE

CERTIFICATE OF CORRECTION

PATENT NO. : 5,181,970

DATED : January 26, 1993

INVENTOR(S) : UEDA et al.

It is certified that error appears in the above-identified patent and that said Letters Patent is hereby corrected as shown below:

Col. 14, line 29, after "claim" insert --1 or--.

Col. 14, line 34, delete "aid" and insert --said--.

Col. 14, line 39, delete "he" and insert --the--.

Signed and Sealed this

Twenty-fifth Day of October, 1994

*Attest:*

Bruce Lehman

BRUCE LEHMAN

*Attesting Officer*

*Commissioner of Patents and Trademarks*